US009492844B2

(12) United States Patent
Hasegawa et al.

(10) Patent No.: US 9,492,844 B2
(45) Date of Patent: Nov. 15, 2016

(54) METHOD FOR FORMING METAL COMPONENT

(75) Inventors: Kenji Hasegawa, Tokyo (JP); Nobuhisa Ito, Tokyo (JP)

(73) Assignee: YKK Corporation (JP)

( * ) Notice: Subject to any disclaimer, the term of this patent is extended or adjusted under 35 U.S.C. 154(b) by 778 days.

(21) Appl. No.: 13/703,070

(22) PCT Filed: Jun. 8, 2010

(86) PCT No.: PCT/JP2010/059712

§ 371 (c)(1),
(2), (4) Date: Dec. 10, 2012

(87) PCT Pub. No.: WO2011/155029

PCT Pub. Date: Dec. 15, 2011

(65) Prior Publication Data

US 2013/0078427 A1 Mar. 28, 2013

(51) Int. Cl.

| | |
|---|---|
| ***B05D 5/00*** | (2006.01) |
| ***A44B 1/02*** | (2006.01) |
| ***A44B 1/04*** | (2006.01) |
| ***A44B 17/00*** | (2006.01) |
| ***A44B 19/26*** | (2006.01) |

(Continued)

(52) U.S. Cl.

CPC . *B05D 5/00* (2013.01); *A44B 1/02* (2013.01); *A44B 1/04* (2013.01); *A44B 17/00* (2013.01); *A44B 19/262* (2013.01); *A44C 27/002* (2013.01); *B44C 1/22* (2013.01); *B44C 3/005* (2013.01); *Y10T 428/24479* (2015.01)

(58) Field of Classification Search

CPC ..... B44C 1/22

See application file for complete search history.

(56) References Cited

U.S. PATENT DOCUMENTS 1,821,578 A * 9/1931 Povalski ..... B44B 5/009 101/3.1

FOREIGN PATENT DOCUMENTS

| | | |
|---|---|---|
| JP | S60-23031 A | 2/1985 |
| JP | 62-174108 A | 7/1987 |

(Continued)

OTHER PUBLICATIONS

Office Action, Japanese Patent Application No. 2012-519163, Aug. 13, 2013.

(Continued)

*Primary Examiner* — Nathan Empie

(74) *Attorney, Agent, or Firm* — Kilpatrick Townsend & Stockton LLP

(57) ABSTRACT

A multi-face part is provided on a half-finished product which eventually becomes a metal decorative button. The multi-face part includes a plurality of small sectional faces and ridges obtusely joining between two adjacent small sectional faces. An outside of the half-finished product including the multi-face part is plated. Then, the half-finished product is barrel-polished. Thereby, the plating on portions corresponding to the small sectional faces remains and the plating on portions corresponding to the ridges is removed, exposing the ground color of the half-finished product. Then, the multi-face part is partially compressed to form the metal decorative button having a compressed decorative surface. The compressed decorative surface is given a pattern composed of a plurality of small sectional parts corresponding to the small sectional faces with the plating left and boundaries corresponding to the ridges with the plating removed.

4 Claims, 20 Drawing Sheets

(51) Int. Cl.

| | |
|---|---|
| ***A44C 27/00*** | (2006.01) |
| ***B44C 1/22*** | (2006.01) |
| ***B44C 3/00*** | (2006.01) |

(56) References Cited

FOREIGN PATENT DOCUMENTS

| | | | | |
|---|---|---|---|---|
| JP | 62-129003 | A | | 11/1987 |
| JP | 62298481 | A | * | 12/1987 |
| JP | 084211/1993 | | | 11/1993 |
| JP | 07-256351 | A | | 10/1995 |
| JP | 07-314994 | A | | 12/1995 |
| JP | 2005-169926 | | | 6/2005 |
| JP | 2007282971 | A | * | 11/2007 |
| JP | 3141812 | | | 4/2008 |
| JP | 2008-099872 | A | | 5/2008 |
| JP | 2008-049599 | | | 3/2009 |
| JP | 2009-050430 | A | | 3/2009 |

OTHER PUBLICATIONS

International Search Report, PCT Application No. PCT/JP2010/059712, mailed Sep. 21, 2010.

* cited by examiner

METHOD FOR FORMING METAL COMPONENT

This application is a national stage application of PCT/JP2010/059712 which is incorporated herein by reference.

BACKGROUND OF THE INVENTION

The present invention relates to a metal component and a method for forming the metal component, and more particularly to a metal component, having a novel planner pattern, such as a metal button, a metal button fixing member, metal components for a slide fastener and the like, and a method for forming such a metal component.

On a front surface of a metal component such as button, a button fixing member, a lower stopper or a puller for a slide fastener, various patterns etc. are conventionally provided such as by printing, inscription. Those patterns are common. JP S60-23031,A discloses a method where, after a button having a projected part on its front side is dyed, the button is barrel-polished to remove dye compound on corners of the projected part to take on an old colored metallic tone. However, the method in the above document cannot be applied to a button without such a projected part. Also, a planner pattern cannot be obtained from the method.

[Patent Document 1] JP S60-23031,A

An object of the present invention is to provide a metal component having a novel planner pattern which differs from patterns obtained such as by printing, inscription, and a method for forming the metal component.

SUMMARY OF THE INVENTION

In order to solve the above-mentioned problems, according to the present invention, there is provided a metal component having a compressed decorative surface which is formed by compression in a gently planar or curved form, wherein said compressed decorative surface has a pattern which is composed of a plurality of small sectional parts on which a coating material as coated remains and boundaries between adjacent small sectional parts on which the coated coating material is removed.

In the metal component according to the invention, a pattern is provided on the compressed decorative surface, the pattern being composed of a plurality of the small sectional parts on which the coating material remains at it is and the boundaries between adjacent small sectional parts on which the coating material as once coated has been removed. The compressed decorative surface is formed by compression in a gently planar or curved form. As a material of the metal component, aluminum alloy, copper alloy and the like are preferably quoted, but not limited thereto.

In an embodiment of the invention, the metal component is a button or a button fixing member. Here, the button includes a decorative button, a button of a type which is inserted into or pulled out from a button hole, a snap button (a male snap button and a female snap button) and the like. The decorative button includes a button used, for example, as a fixing member for pockets of jeans, and a circular, rectangular, or polygonal button (plate) used to decorate shoes, belts and the like. The button fixing member is a component for fixing to a cloth etc. a button such as a decorative button, a button inserted into or pulled out from a button hole, a snap button. The button fixing member includes a base and one or a plurality of shafts which protrude from the base. The button is fixed to a cloth etc. The button is fixed to a cloth etc. by deforming the shaft after it pierces a cloth etc. to fasten the button.

In an embodiment of the invention, the metal component is a component for a slide fastener. As examples of the component for a slide fastener, an upper stopper, a lower stopper, a puller, a fastener element, a slider and the like can be quoted.

According to another aspect of the present invention, there is provided a method for forming a metal component having a compressed decorative surface which is gently planar or curved, wherein the compressed decorative surface has a pattern which is composed of a plurality of small sectional parts on which a coating material as coated remains and boundaries between adjacent small sectional parts on which the coated coating materials is removed, wherein the method includes: a step A of obtaining a half-finished product which becomes the metal component, the half-finished product including a multi-face part which includes, in at least a part of the outside area thereof, a plurality of small sectional faces and ridges obtusely joining between two adjacent small sectional faces; a step B of coating the multi-face part with a coating material whose color differs from the ground color of the outside area; a step C of removing the coating material on portions corresponding to the ridges of the multi-face part and leaving the coating material on portions corresponding to the small sectional faces; and a step D of compressing at least a part of the multi-face part to form the compressed decorative surface in which the portions corresponding to the small sectional faces become the small sectional parts and the portions corresponding to the ridges become the boundaries.

In the invention, a multi-face part is provided on the half-finished product which finally becomes the metal component. The multi-face part includes a plurality of the small sectional faces and the ridges between the small sectional faces. The multi-face part is coated with a coating material. Then, the coating material on portions corresponding to the ridges is removed by e.g. polishing. After that, the multi-face part is compressed in a planar or curved shape to form the compressed decorative surface. On the compressed decorative surface, the portions corresponding to the small sectional faces on which the coating material remains become the small sectional part, and the portions corresponding to the ridges on which the coating material is removed become the boundaries. As the step B of coating the multi-face part with a coating material, a plating process can be used as described later. Other than that, a process for applying or immersing a dye compound and the like can be quoted.

In an embodiment of the invention, the metal component is a button or a button fixing member. Here, the button includes a decorative button, a button of a type which is inserted into or pulled out from a button hole, a snap button (a male snap button and a female snap button) and the like. The decorative button includes a button used, for example, as a fixing member for pockets of jeans, and a circular, rectangular, or polygonal button (plate) used to decorate shoes, belts and the like. The button fixing member is a component for fixing to a cloth etc. a button such as a decorative button, a button inserted into or pulled out from a button hole, a snap button. The button fixing member includes a base and one or a plurality of shafts which protrude from the base. The button is fixed to a cloth etc. The button is fixed to a cloth etc. by deforming the shaft after it pierces a cloth etc. to fasten the button.

In an embodiment of the invention, the metal component is a component for a slide fastener. As examples of the component for a slide fastener, an upper stopper, a lower stopper, a puller, a fastener element, a slider and the like can be quoted.

In an embodiment of the invention, the step B is carried out by plating the multi-face part. The plating includes electrical plating, non-electrolyte plating, hot dip zincing, chemical conversion treatment, chemical coloration and the like.

In an embodiment of the invention, the step C is carried out by barrel-polishing the half-finished product. Through the barrel-polishing, the coating material on the portions corresponding to the ridges of the multi-face part is stripped, and thereby the border between the portions on which the coating material has been removed and the portions on which the coating material remains becomes dim, which can expresses an old colored pattern on the compressed decorative surface.

According to the present invention, it is possible to obtain a metal component having a unique pattern on a gently planar or curved, compressed decorative surface as formed by compression, the pattern being composed of a plurality of small sectional parts on which a coating material as coated remains and boundaries between adjacent small sectional parts on which the coated coating material is removed. The metal component can be formed by coating a multi-face part of a half-finished product which becomes the metal component with a coating material, the multi-face part including a plurality of small sectional faces and ridges between the small sectional faces, removing the coating material only on portions corresponding to the ridges, and then compressing the multi-face part. The pattern composed of the small sectional parts on which the coating material remains and the boundaries on which the coating material is removed is novel and different from conventional patterns obtained by printing, inscription and the like.

DETAILED DESCRIPTION OF THE INVENTION

Figure 1:
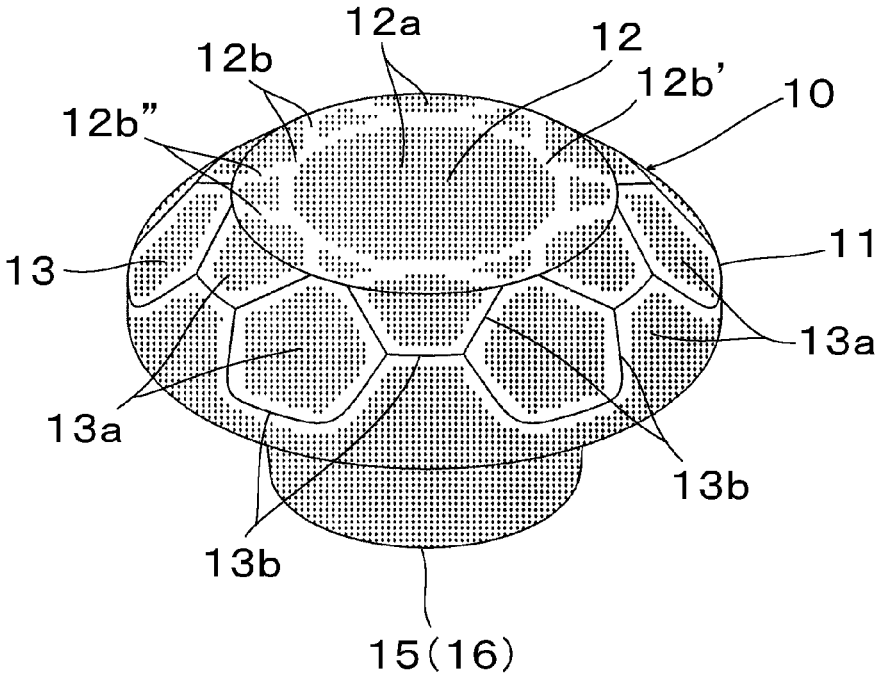
FIG. 1 is a perspective view showing a decorative button which is an example of a metal component in accordance with the present invention.
Figure 2:
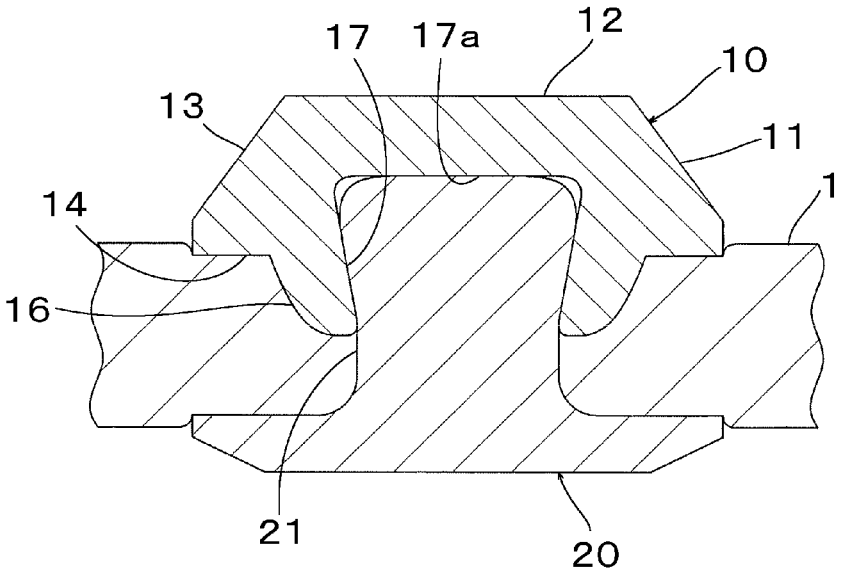
FIG. 2 is a longitudinal cross-sectional explanatory view showing a state where the decorative button in FIG. 1 is fixed to a cloth by a button fixing member.
Figure 9:
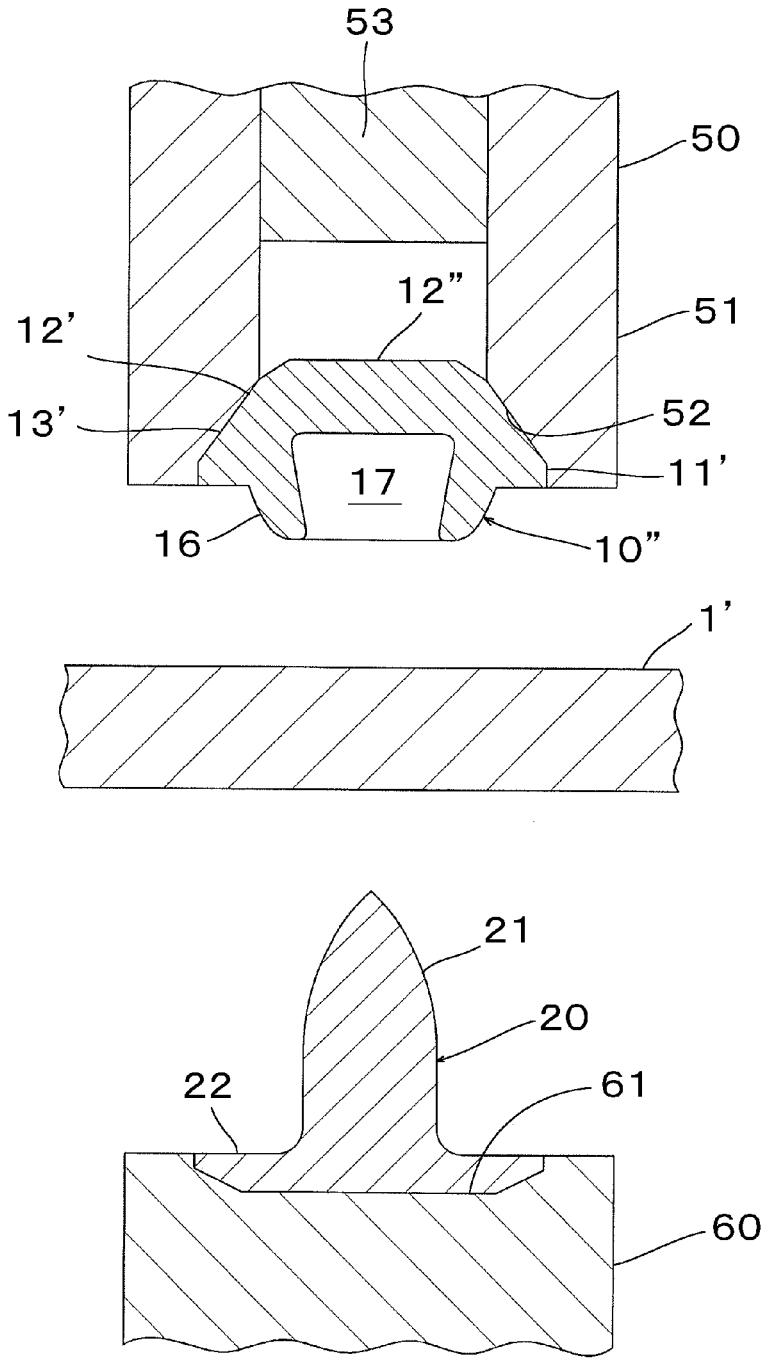
FIG. 9 is a longitudinal cross-sectional explanatory view showing a state where the upper die, another half-finished product, a cloth and the lower die are arranged.

Hereinafter, preferable embodiments of the present invention will be described with reference to the drawings. FIG. 1 is a perspective view of a decorative button (hereafter also referred to merely as "button") 10 as a metal component according to an embodiment of the invention. FIG. 2 is a longitudinal cross-sectional view showing a state where the button 10 is fixed to a cloth 1 using a button fixing member 20 (the fixing member 20 prior to being deformed is shown in FIG. 9). The button 10 is made of aluminum alloy, copper alloy and the like and used, for example, as a fixing member for pockets of jeans. The button 10 includes a button body 11 having a circular outer circumference and a shaft locking part 15 for receiving, deforming and then locking a shaft 21 of the fixing member 20 after the shaft 21 has pierced the cloth 1. The button body 11 has front surfaces (12, 13) which are visible in a state where the button 10 is fixed to the cloth 1 and a rear surface 14 which is invisible in contact with the cloth 1. The shaft locking part 15 is formed on the rear surface 14 side. The shaft locking part 15 includes a cylindrical part 16 which protrudes downward (up and down direction is based on FIG. 2) from the rear surface 14 of the button body 11 concentrically with the button body 11, and a locking space 17, radially inward of the cylindrical part 16, which is depressed upwardly deeply beyond the level of the rear surface 14 of the button body 11. The inner diameter of the cylindrical part 16 gradually reduces slightly downward so that the shaft 21 of the fixing member 20 would not come out. The diameter of the locking space 17 also reduces downward. The cylindrical part 16 is formed such that its diameter reduces downward after a half-finished product 10' (see FIG. 3 etc.) as described later is die-cast-molded. The radial thickness of the cylindrical part 16 is gradually thinned slightly downward. The upper end face 17*a* of the locking space 17 is flat and closed.

The front surface of the button body 11 has a flat and circular compressed decorative surface 12 which is along a plane (hereinafter referred to as "horizontal plane") perpendicular to the axis of the button body 11, and an annular multi-face decorative surface 13 which inclines downward and radially outward from the outer circumference of the compressed decorative surface 12. The rear surface 14 is parallel to the compressed decorative surface 12. A radially outer and lower end part of the multi-face decorative surface 13 is an annular vertical surface parallel to the axis. The multi-face decorative surface 13 has a polyhedral appearance composed of many small sectional faces 13*a*, which are flat and hexagonal or trapezoidal or the like, respectively, and ridges 13*b*, each of which obtusely joins two adjacent small sectional faces 13*a*. On the multi-face decorative surface 13, a pattern such as a shell of a tortoise is formed by plating the multi-face decorative surface 13 and then barrel-polishing the surface so as to leave plated portions corresponding to the small sectional faces 13*a* and to remove plated portions corresponding to the ridges 13*b* to expose the ground color of the button body 11, as described in detail later. Also, on the compressed decorative surface 12, a pattern is given which is composed of a plurality of circular and trapezoidal small sectional parts 12*a* on which the plating remains, and boundaries 12*b* between adjacent small sectional parts 12*a* on which the plating has been removed. The boundary 12*b* is composed of a first boundary 12*b*' which is circular and second boundaries 12*b*" radially outward from the first boundary 12*b*', the second boundaries 12*b*" being like flatly crushed ridges 13*b* of the multi-face decorative surface 13.

Figure 3:
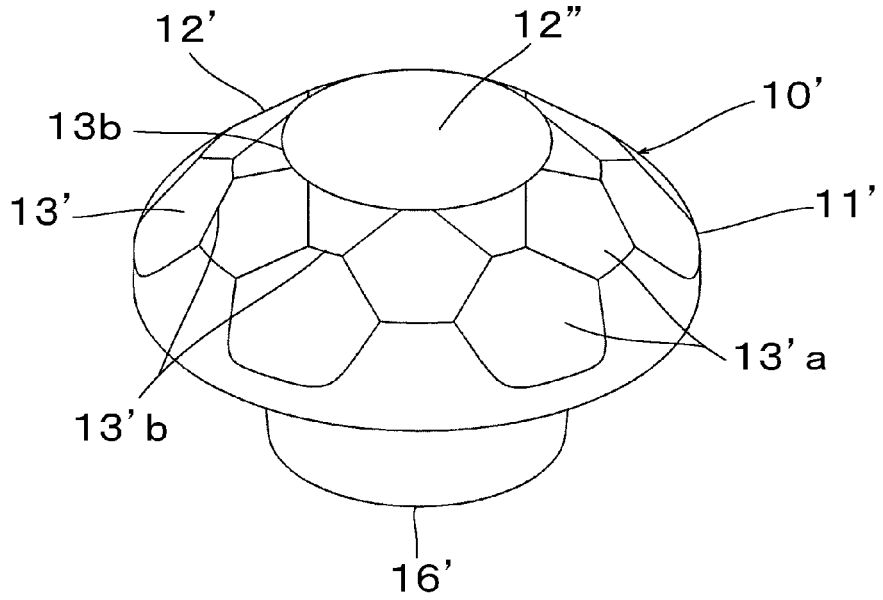
FIG. 3 is a perspective view showing a half-finished product which becomes the decorative button in FIG. 1.
Figure 4:
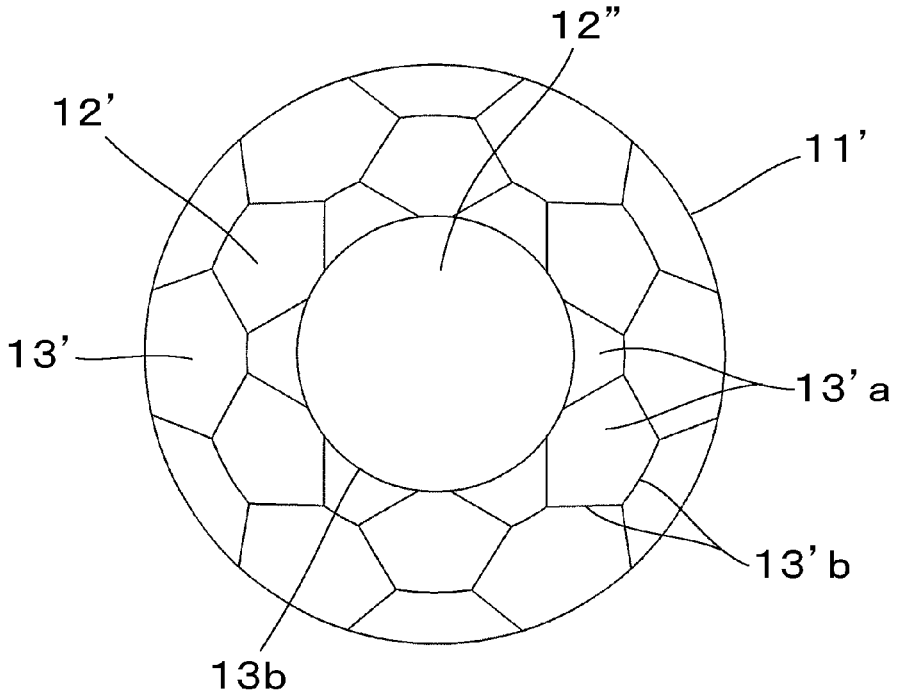
FIG. 4 is a plan view showing the half-finished product in FIG. 3.

Next, a procedure of forming the above decorative button 10 will be explained, as an embodiment of a method of forming a metal component in accordance with the present invention. FIG. 3 is a perspective view showing a half-finished product 10', which is a die-cast intermediate product to be finally formed to the button 10. FIG. 4 is a plan view of the half-finished product 10'. The half-finished product 10' has a main body 11' which becomes the button body 11 of the button 10, and a cylindrical part 16' and a locking space 17' (see FIG. 7) which become the shaft locking part 15 (the cylindrical part 16 and the locking space 17) of the button 10. The main body 11' includes a multi-face part 12' which becomes the compressed decorative surface 12 and the multi-face decorative surface 13 of the button body 11, and the rear surface 14 (see FIG. 7; the same reference numeral as the rear surface 14 of the button body 11 is assigned because they are substantially identical.). The multi-face part 12' includes a flat circular face 12" which is along the horizontal plane and concentrically with the main body 11', and an annular multi-face main part 13' which inclines downward and radially outward from the outer circumference of the circular face 12" in a slightly convex spherical form. The multi-face main part 13' includes a polyhedral appearance composed of many small sectional faces 13'*a*, which are flat and hexagonal or trapezoidal or the like, respectively, and ridges 13'*b*, each of which obtusely joins two adjacent small sectional faces 13*a*'. The circular face 12" is one of the small sectional faces on the multi-face part 12'. Between the circular face 12" and the multi-face main part 13', there is also a circular ridge 13*b* which obtusely joins them. The axial thickness of the main body 11', namely the interval between the circular face 12" and the rear surface 14 in the axial direction is slightly thicker (larger) than that of the button body 11. Further, the diameter of the circular face 12" is smaller than that of the compressed decorative surface 12 of the button 10 and equal to the diameter of the first boundary 12*b*'. At this stage, the inner diameter of the cylindrical part 16' and the diameter of the locking space 17' are substantially constant (see FIG. 7).

Figure 5:
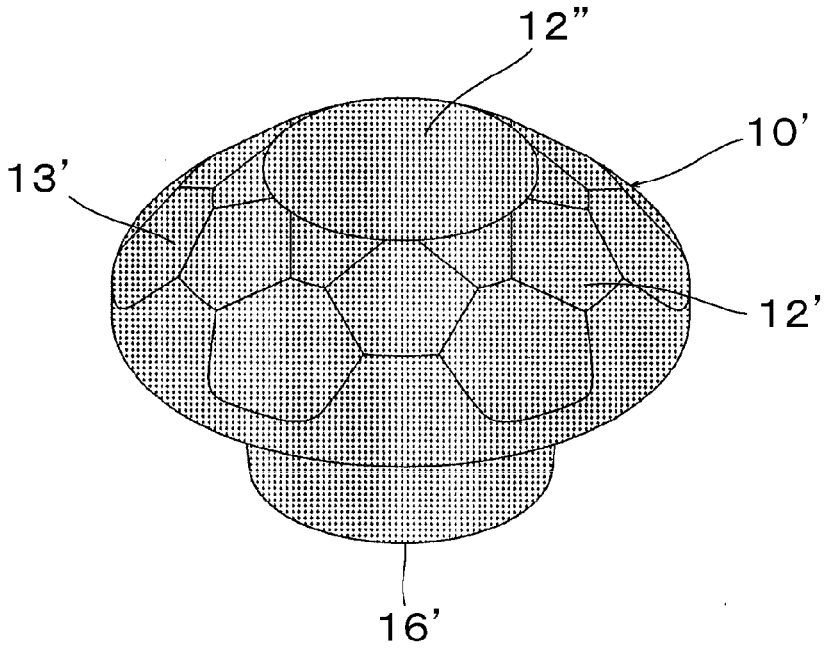
FIG. 5 is a perspective view showing a plated half-finished product.
Figure 6:
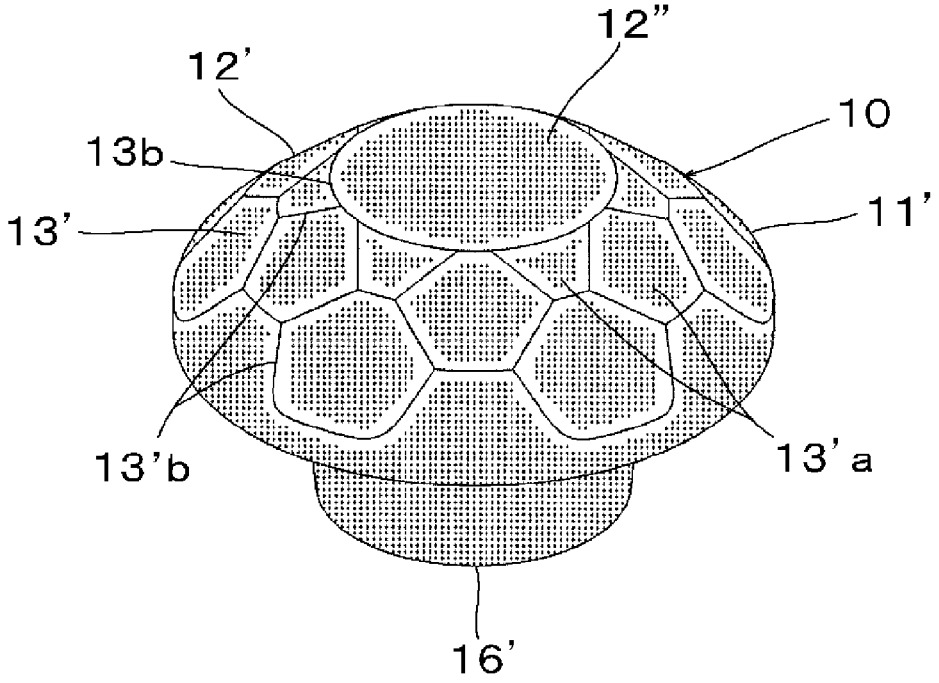
FIG. 6 is a perspective view showing a barrel-polished half-finished product.
Figure 7:
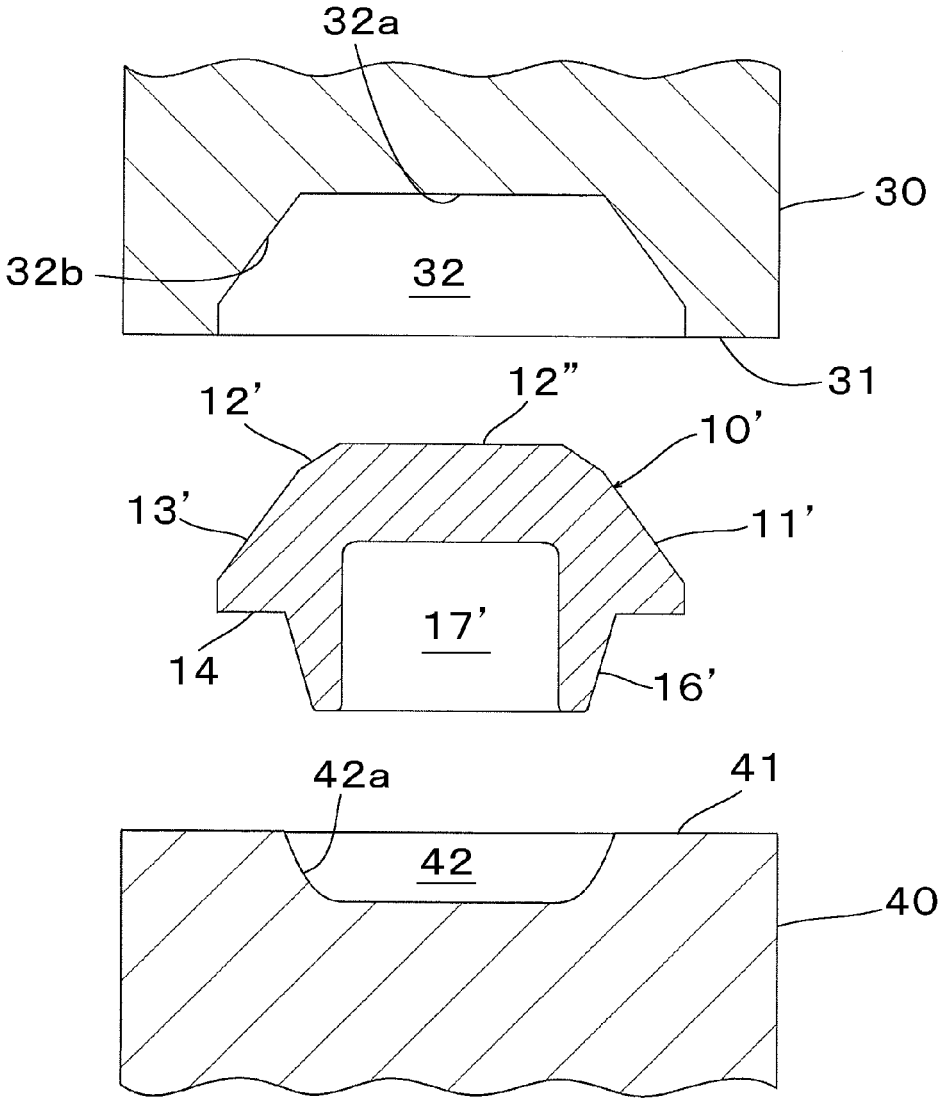
FIG. 7 is a longitudinal cross-sectional explanatory view showing a state, where an upper die, the half-finished product and a lower die are arranged.

Next, as shown in FIG. 5, the half-finished product 10' is plated on its whole outside area except the locking space 17', the color of the plating being different from the ground color of the half-finished product 10'. It is possible to plate only the multi-face part 12' of the main body 11', namely the circular face 12" and the multi-face main part 13'. Next, as shown in FIG. 6, the plated half-finished product 10' is barrel-polished, while the plated portions corresponding to the circular face 12" and the small sectional faces 13'*a* are left and the plated portions corresponding to the ridges 13*b*, 13'*b* are removed, exposing the ground color of the main body 11' only on the portions corresponding to the ridges 13*b*, 13'*b*. Next, the half-finished product 10' is compressed in the axial direction using an upper die 30 and a lower die 40 shown in FIG. 7 to form the decorative button 10 as a finished product. With reference to FIG. 7, the upper die 30 has an upper cavity 32 which is depressed upward from its bottom surface 31. The upper cavity 32 is shaped to conform to the outer shape of the button body 11 of the button 10. Thus, the axial depth of the upper cavity 32 is slightly smaller than the thickness of the main body 11' of the half-finished product 10'. The upper cavity 32 includes a horizontal circular face 32*a* corresponding to the compressed decorative surface 12 and an annular inclined surface 32*b* corresponding to the multi-face decorative surface 13. The lower die 40 has a lower cavity 42 which is depressed downward from its top surface 41. The lower cavity 42 is shaped to conform to the outer shape of the cylindrical part 16 of the button 10, the diameter of the lower cavity 42 reducing downward. The lower cavity 42 has an annular curved face 42*a* to draw the cylindrical part 16' of the half-finished product 10' radially inward.

Figure 8:
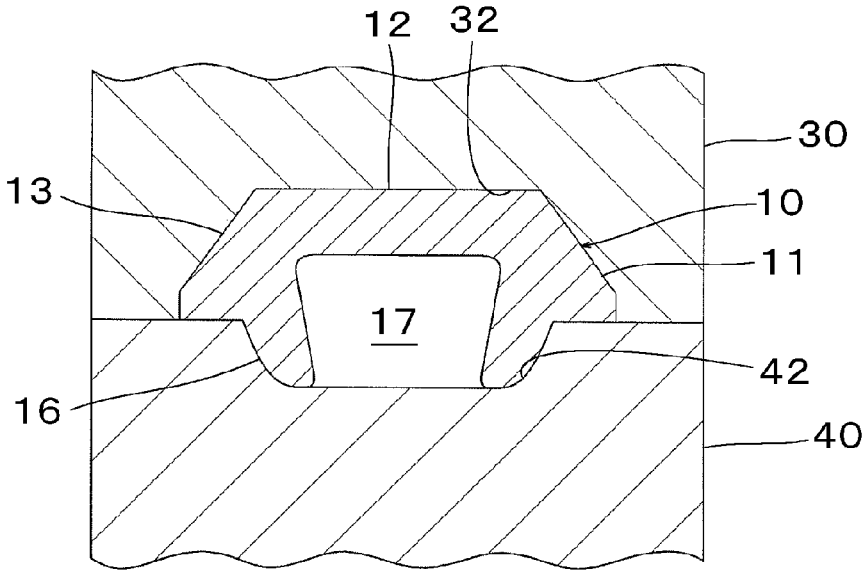
FIG. 8 is a longitudinal cross-sectional explanatory view showing a state where the half-finished product is molded between the upper die and the lower die.

FIG. 8 shows a state where the button 10 is molded by being compressed between the upper and lower dies 30, 40. With this compression, the main body 11' of the half-finished product 10' is slightly crushed in the axial direction into the button body 11, and the cylindrical part 16' is formed to the cylindrical part 16 while the diameter of the cylindrical part 16' reduces downward.

At this time, the horizontal circular face 32*a* of the upper cavity 32 also pushes the main body 11' downward from the circular face 12". Thereby, an upper portion of the multi-face main part 13' becomes planar and flush with the circular face 12" around the circular face 12". The compressed decorative surface 12 is formed by expanding the circular face 12". At this time, on the upper portion of the multi-face main part 13' as taken in the compressed decorative surface 12, the ridges 13*b*, 13'*b* are crushed and become lost (minute traces may be left). Then, the circular face 12" and the small sectional faces 13'*a* which are planar and adjacent to each other with the crushed ridges 13*b*, 13'*b* between them become the small sectional parts 12*a* on the compressed decorative surface 12. Also, the plating-removed portions corresponding to the ridges 13*b*, 13'*b* become the boundaries 12*b* (the first and second boundaries 12*b*', 12*b*") on the compressed decorative surface 12. Further, the multi-face main part 13' except for its upper portion taken in the compressed decorative surface 12 becomes the multi-face decorative surface 13 of the button body 11, wherein the plating-remaining portions and the plating-strapped portions construct a pattern. When the decorative button 10 obtained as described above is fixed to the cloth 1 as shown in FIG. 2, the button 10 is held by the upper die (not shown) above the cloth 1 placed horizontally, and the fixing member 20 is set on a lower die 60 (see FIG. 9) below the cloth 1. Then, the upper die is lowered. Thereby, the shaft 21 of the fixing member 20 pierces the cloth 1 and comes into the locking space 17 of the button 10, and then hits against the upper end face 17*a* to be plastically deformed axially such that the shaft 21 is axially crushed and radially expanded. After this deformation, the shaft 21 is locked by the cylindrical part 16 in an undetachable manner. As a result, the button 10 is fixed to the button 10.

Figure 10:
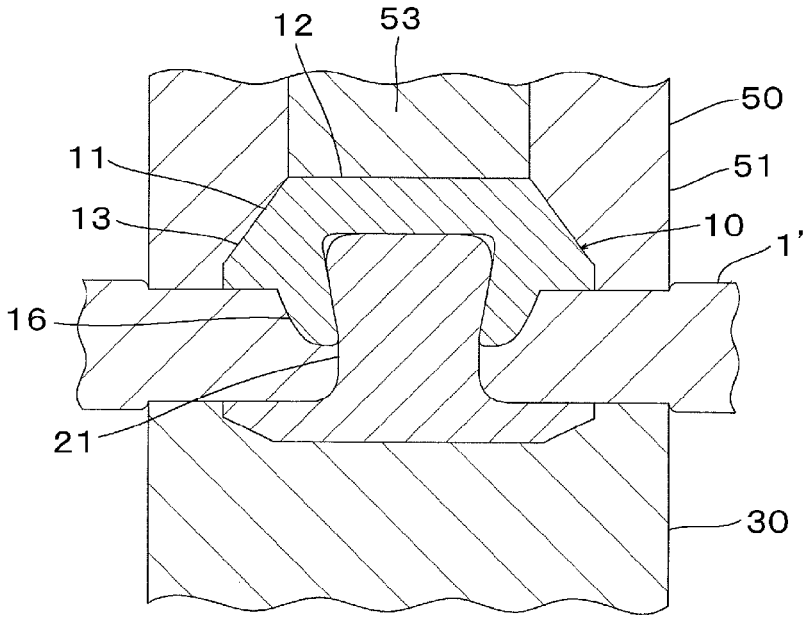
FIG. 10 is a longitudinal cross-sectional explanatory view showing a state where a compressed decorative surface is formed by the upper die as the half-finished product is fixed to the cloth.

In the above-described example, the molding process from the main body 11' of the half-finished product 10' to the button body 11 of the button 10 and the diameter-reducing process from the cylindrical part 16' to the cylindrical part 16 are carried out at the same time. However, those processes can be carried out separately as described below. In a half-finished product 10" in FIG. 9 corresponds to the half-finished product 10' in which the cylindrical part 16' has already been formed to the cylindrical part 16 but the main body 11' has not been formed to the button body 11 yet. Therefore, the half-finished product 10" includes the multi-face part 12' corresponding to that of the half-finished product 10', namely, the circular face 12" and the multi-face main part 13' (the same reference numerals as the multi-face 12', the circular face 12" and the multi-face main part 13' of the half-finished product 10' are assigned because they are substantially identical), and the locking space 17 (the same reference numeral as the locking space 17 of the button 10 is assigned because they are substantially identical) corresponding to that of the button 10. When the half-finished product 10" is fixed to the cloth 1 using the fixing member 20, by using an upper die 50 to form the main body 11' to the button body 11, the half-finished product 10" can be fixed to the cloth 1 as the decorative button 10. With reference to FIG. 9, the upper die 50 comprises a cylindrical die body 51 and a columnar punch 53 which can move up and down through a hollow inside the die body 51. The die body 51 includes, at its lower end, an annular button holder 52 which is excised to the shape conforming to the outer shape of the main body 11' of the half-finished product 10". The inner diameter of the die body 51 and the outer diameter of the punch 53 are set to be identical to the diameter of the compressed decorative surface 12 of the button 10. The lower die 60 has, on its top, a dent 61 conforming to a base 22 of the fixing member 20. When the half-finished product 10" is fixed to a cloth 1', the half-finished product 10" is held in the button holder 52 of the die body 51 of the upper die 50 above the cloth 1', and the fixing member 20 is set in the dent 61 of the lower die 60 below the cloth 1'. After that, the upper die 50 is lowered and the punch 53 is moved downward relatively to the die body 51. Thereby, after the shaft 21 of the fixing member 20 pierces the cloth 1', as shown in FIG. 10, the shaft 21 is deformed and fastened in the locking space 17 in the half-finished product 10" as described above. At this time, the punch 53 crushes the member body 10' of the half-finished product 10" slightly in the axial direction. Then, similarly to the molding by the upper die 30 as mentioned above, the compressed decorative surface 12 is formed around the circular face 12" taking in a part of the multi-face main part 13', and the remainder of the multi-face main part 13' becomes the multi-face decorative surface 13. Thereby, the half-finished product 10" is fixed to the cloth 1' while it is formed to the decorative button 10.

Figure 11:
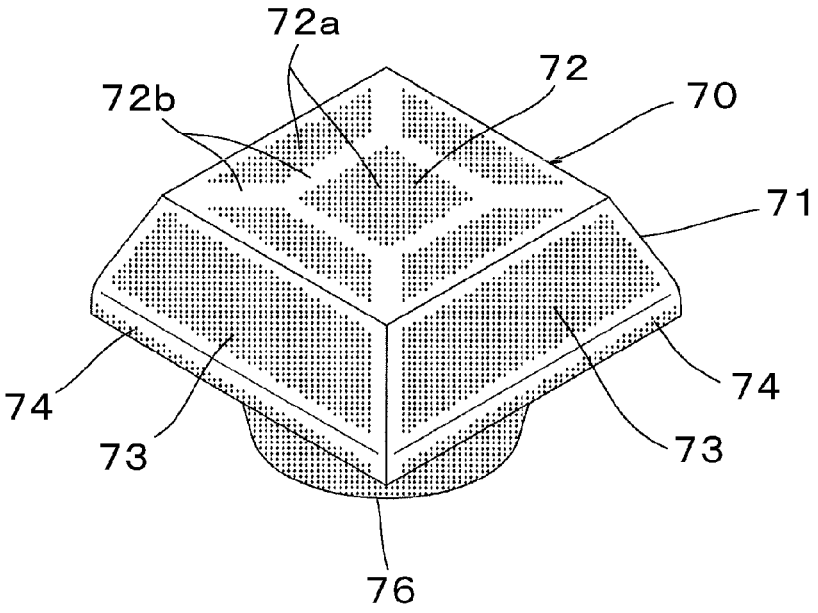
FIG. 11 is a perspective view showing another example of a decorative button, which is a metal component in accordance with the present invention.
Figure 12:
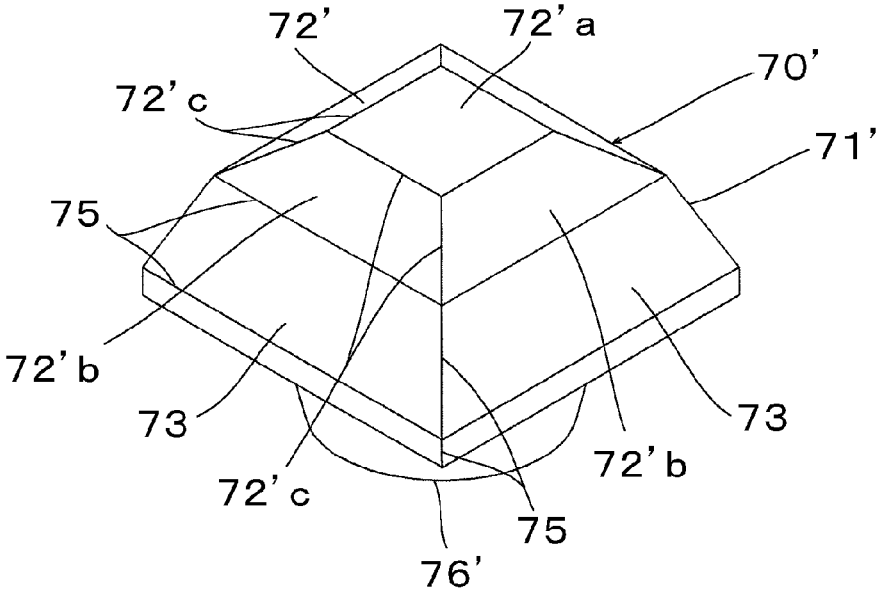
FIG. 12 is a perspective view showing a half-finished product which becomes the decorative button in FIG. 11.
Figure 13:
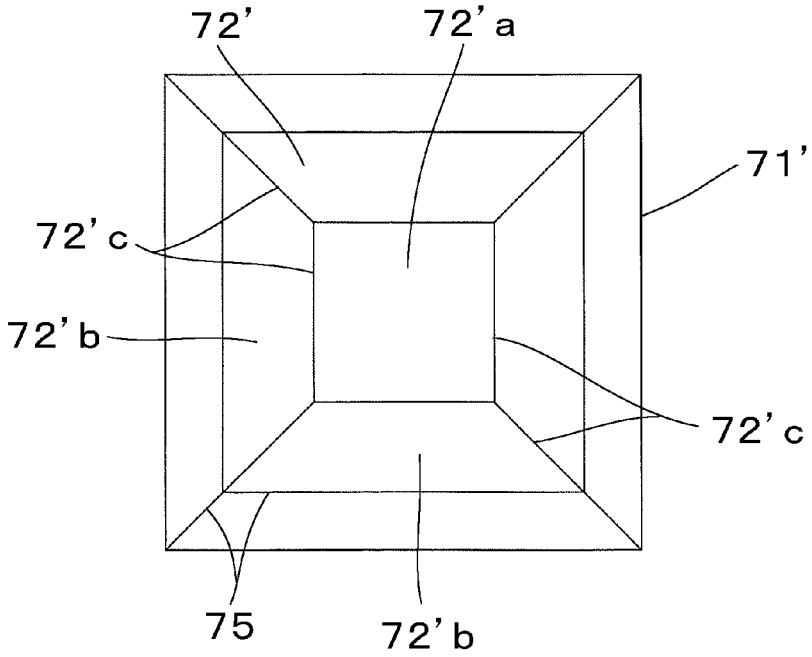
FIG. 13 is a plan view of the half-finished product in FIG. 12.
Figure 14:
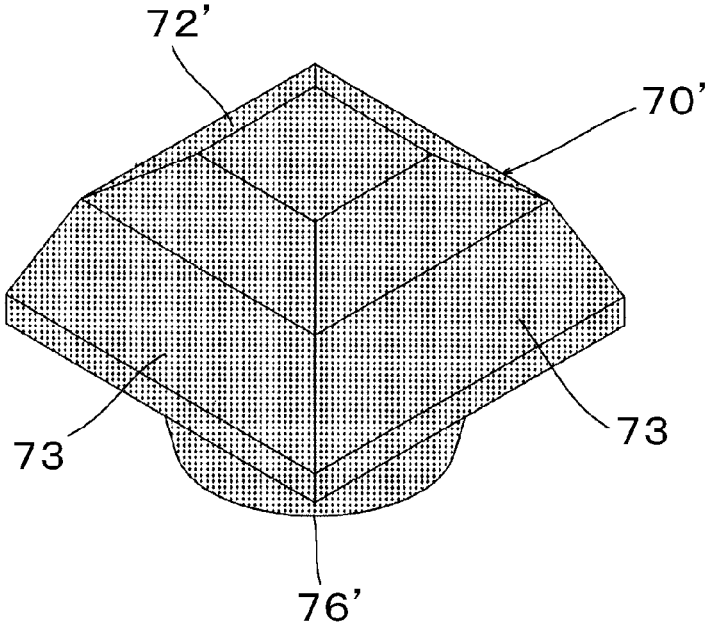
FIG. 14 is a perspective view showing a plated half-finished product.
Figure 15:
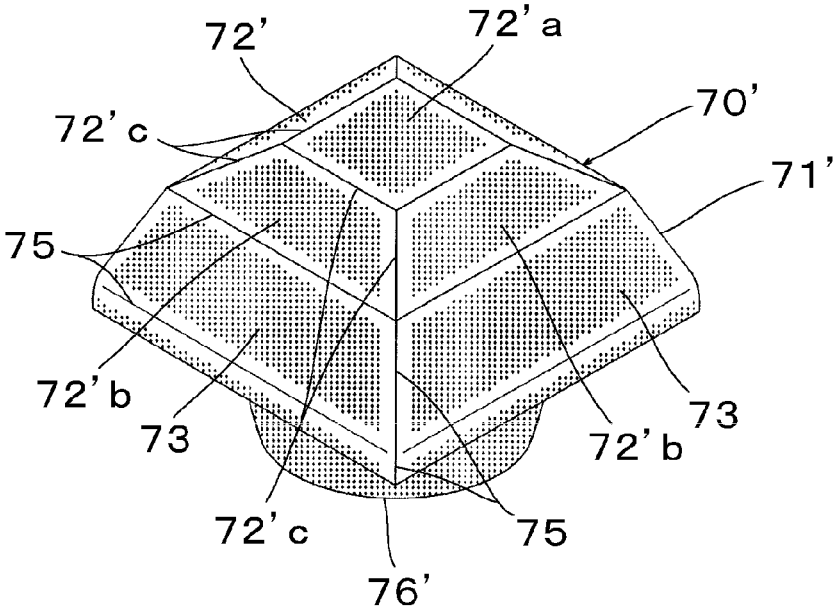
FIG. 15 is a perspective view showing a barrel-polished half-finished product.

FIG. 11 is a perspective view showing a decorative button in accordance to another embodiment of the present invention. A decorative button 70 comprises a button body 71, and a shaft locking part, which is provided on the rear side of the button body 71 and includes a cylindrical part 76 and a locking space (not shown) as in the button 10. The button body 71 includes a square compressed decorative surface 72 along a horizontal surface, four trapezoidal sides 73 which incline downward and outward from the four outer edges of the compressed decorative surface 72, and a rear surface (not shown) from which the cylindrical part 76 protrudes downward. On the compressed decorative surface 72, a pattern is given which is composed of five small sectional parts 72*a* on which the plating remains and boundaries 72*b* between adjacent small sectional parts 72*a* on which the plating has been removed. The small sectional part 72*a* has a square smaller than the compressed decorative surface 12 and four trapezoids around the square. Each of the sides 73 includes a vertical side 74 on its lower end. FIGS. 12 and 13 are respectively a perspective view and a plan view showing a half-finished product 70' as a die-cast intermediate product to be finally formed to the button 70. The half-finished product 70' includes a member body 71' to be the button body 71 of the button 70 and a cylindrical part 76' which becomes the cylindrical part 76 of the button 70. The member body 71' includes a multi-face part 72' which becomes the compressed decorative surface 72 of the button body 71 and four sides 73 (the same reference numeral as the sides 73 of the button 70 is assigned because they are substantially identical) which become the four sides 73 of the button body 71. The multi-face part 72' has a polyhedral appearance which is convex upward from the horizontal surface along the upper edges of the four sides 73 in a truncated square pyramidal shape. The multi-face part 72' includes, as small sectional faces, a center square face 72'*a* smaller than the compressed decorative surface 72 and along a horizontal plane and four trapezoidal faces 72'*b* which incline downward and outward from the four outer edges of the square face 72'*a* to the upper edges of the four sides 73. The multi-face part 72' also includes ridges 72'*c* obtusely joining between the trapezoidal faces 72'*b* and between the square face 72'*a* and the trapezoidal faces 72'*b*. Besides, in the member body 71', there are ridges 75 between the trapezoidal face 72'*b* and the side 73, between the sides 73, and on the upper edges of vertical sides 74 in the side 73. The half-finished product 70' is plated on the whole outside area thereof (see FIG. 14), and then barrel-polished. Thereby, as shown in FIG. 15, only the plated portions corresponding to the ridges 72'*c*, 75 of the member body 71' are removed, exposing the ground color of the member body 71'. Next, using a die or a punch as not shown, the multi-face part 72' of the half-finished product 70' is axially compressed to the compressed decorative surface 72 which is horizontal along the upper edges of the four sides 73, and thereby the decorative button 70 is formed as shown in FIG. 11. At this time, the square face 72'*a* and the trapezoidal face 72'*b* on which the plating remains become the small sectional parts 72*a* in the compressed decorative surface 72, and the ridges 72'*c* on which the plating is removed become the boundaries 72*b* in the compressed decorative surface 72. The formation from the multi-face part 72' to the compressed decorative surface 72 can be carried out simultaneously with when the cylindrical part 76' is radially reduced to the cylindrical part 76 or when the half-finished product 70' is fixed to the cloth 1, as explained in the example of the button 10.

Figure 16:
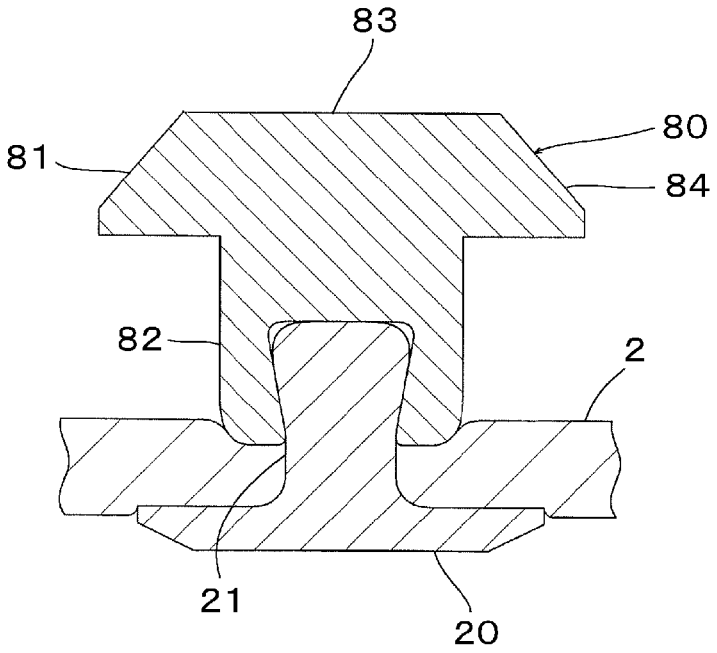
FIG. 16 is a longitudinal cross-sectional explanatory view showing a state where a button of a type taken in and out through a button hole, which is another example of a metal component in accordance with the present invention.

FIG. 16 shows a button 80 for a type taken in and out through a button hole (not shown), as an example other than a decorative button of a metallic component in accordance with the present invention. In FIG. 16, the button 80 is represented in a state where the button 80 is fixed to a cloth 2 by the fixing member 20 (the same reference numeral as the fixing member 20 in FIG. 2 is assigned because they are substantially identical.). The button 80 comprises a head 81 which has a configuration similar to the button body 11 of the decorative button 10 as mentioned above, and a cylindrical barrel 82 which extends downward from the rear surface of the head 81. The head 81 includes a compressed decorative surface 83 which expands radially outward more than the barrel 82 and has a pattern, similar to that of the compressed decorative surface 12 of the button 10, which is composed of plating-remaining portions and plating-removed portions, and a side 84 similar to the multi-face decorative surface 13 in the button 10. The barrel 82 includes a shaft locking part 85 for receiving, deforming and locking the shaft 21 of the fixing member 20 after the shaft 21 pierces the cloth 2. The compressed decorative surface 83 of the head 81 of the button 80 is formed by compressing a multi-face part of a half-finished product as not shown, as with the compressed decorative surface 12 of the button 10.

Figure 17:
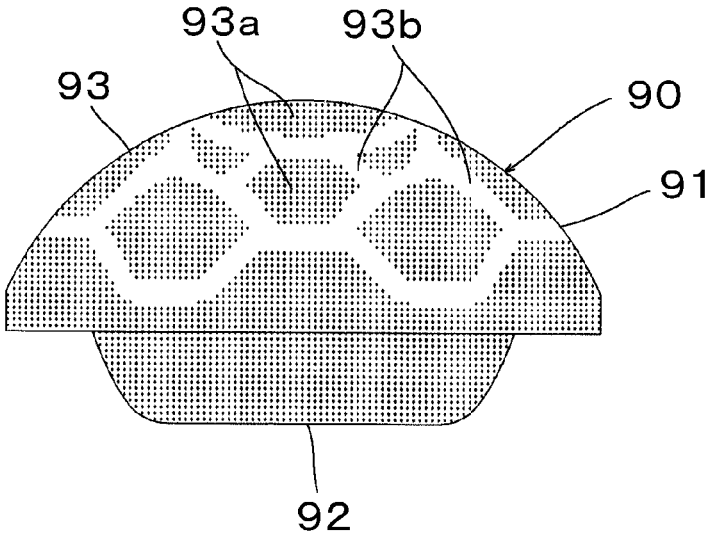
FIG. 17 is a side view showing still another example of a decorative button.

In the above example, the multi-face parts 12', 72' are compressed and formed to the flat compressed decorative surfaces 12, 72, respectively. However, a compressed decorative surface can be formed as a curved surface. FIG. 17 shows a decorative button 90, which is similar to the decorative button 10. The button 90 comprises a button body 91 and a shaft locking part 92 which is substantially identical to the shaft locking part 15 of the button 10. The button body 91 includes a compressed decorative surface 93 in a form of a gentle, convex sphere, on its entire area. The compressed decorative surface 93 includes a pattern composed of a plurality of small sectional parts 93*a* on which the plating remains and boundaries 93*b* between adjacent small sectional parts 93*a* from which the plating is removed. This pattern corresponds to the pattern in which ridges 13*b* are crushed on the multi-face decorative surface 13 of the button 10. Although not shown, the compressed decorative surface 93 is formed by plating, barrel-polishing and compressively molding a half-finished product which has a configuration, as a multi-face part on the entire surface area of the member body, similar to the multi-face main part 13" of the half-finished product 11' becoming the button 10. In this case, the multi-face parts of the half-finished product is formed to be the compressed decorative surface 93 such that adjacent small sectional faces with crushed ridges between them are gently continuous in a curved form.

Figure 18:
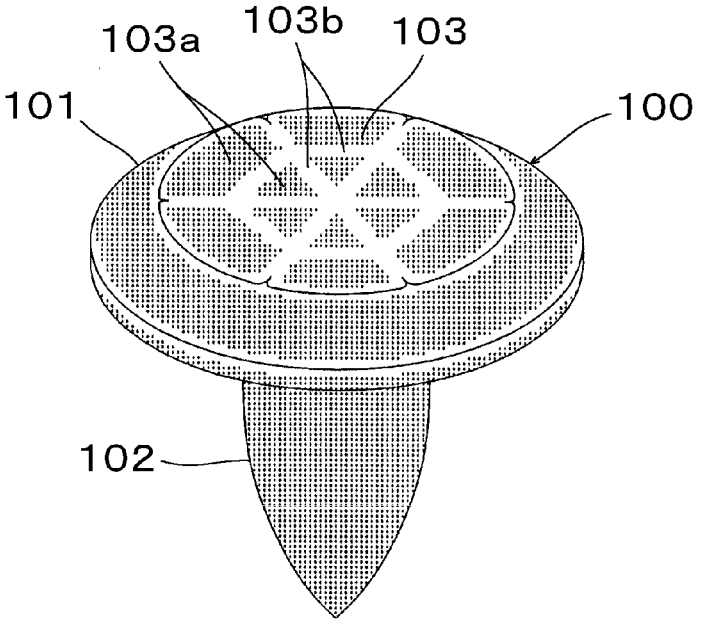
FIG. 18 is a perspective view showing a button fixing member, which is still another example of a metal component in accordance with the present invention.
Figure 19:
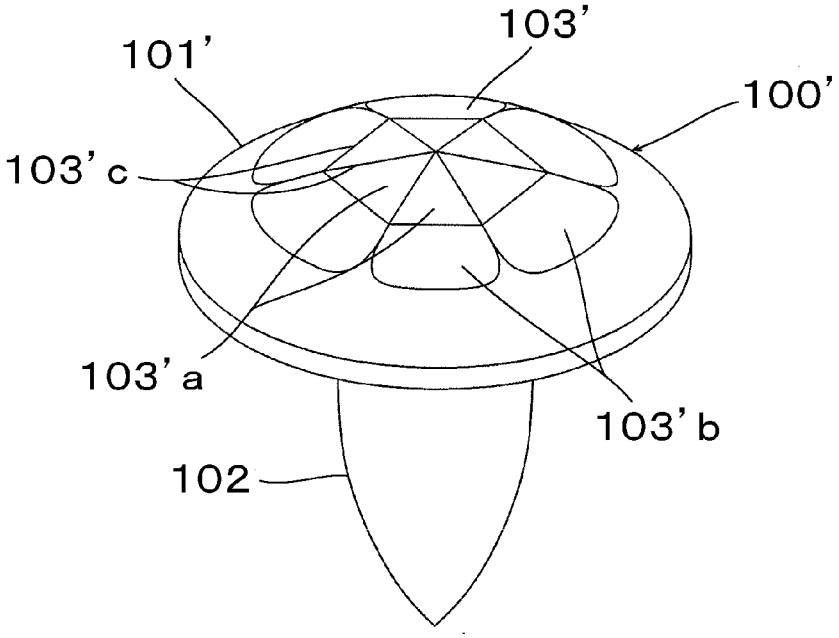
FIG. 19 is a perspective view showing a half-finished product which becomes the fixing member in FIG. 18.
Figure 20:
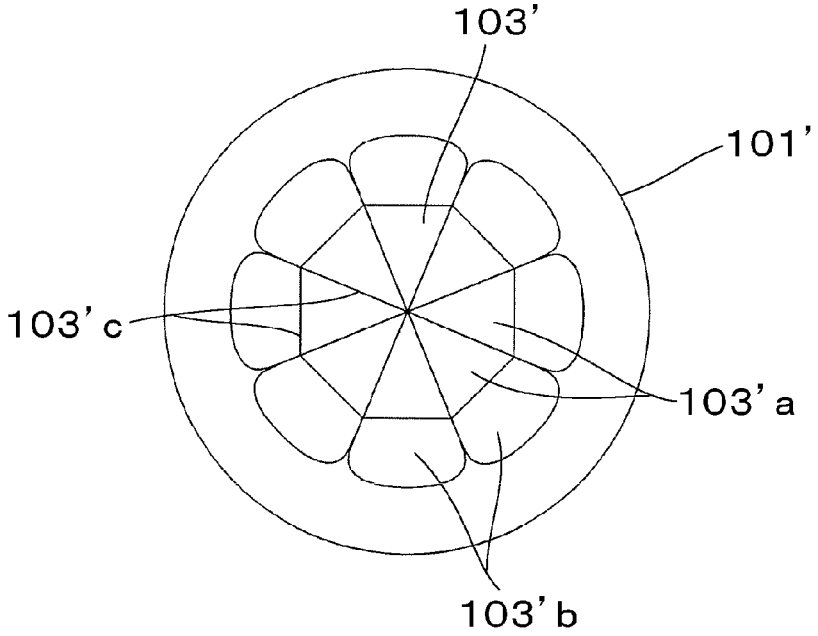
FIG. 20 is a plan view of the half-finished product in FIG. 19.
Figure 21:
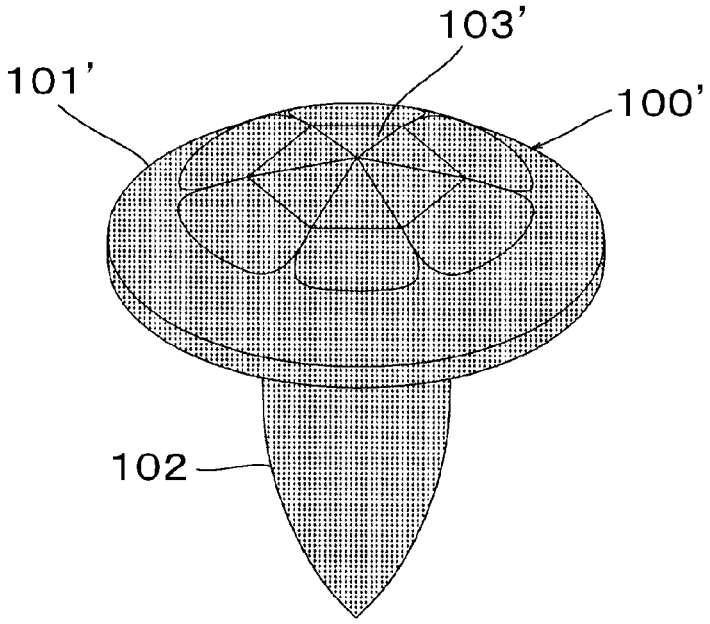
FIG. 21 is a perspective view showing a plated half-finished product.
Figure 22:
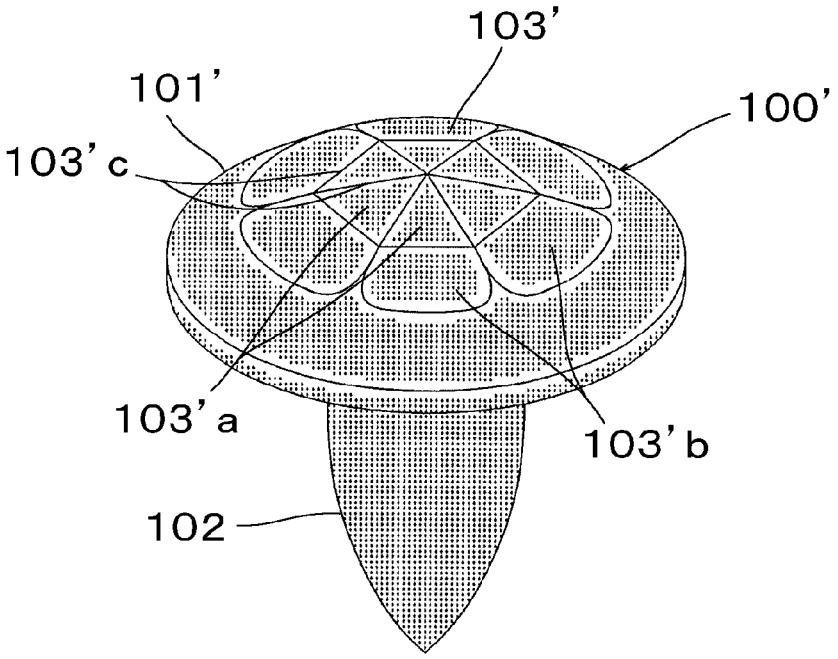
FIG. 22 is a perspective view showing a barrel-polished half-finished product.

FIGS. 18 to 22 show a button fixing member as still another embodiment of a metallic component in accordance with the present invention. With reference to FIG. 18, a fixing member 100 is one for fixing to a cloth a snap button, a decorative button, a button as taken in and out through a button hole, and the like. The fixing member 100 comprises a base 101 and a shaft 102 protruding from the base 101 concentrically with the base 101. As a button is fixed, the shaft 102 pierces the material and then is deformed to fasten on the button. The base 101 includes a circular compressed decorative surface 103 on the front side as being visible in a state where the fixing member 100 is fixed to a cloth. The compressed decorative surface 103 has a pattern composed of a plurality of small sectional parts 103*a* on which the plating remains as described later and boundaries 103*b* between adjacent small sectional parts 103*a* on which the plating is removed. The small sectional parts 103*a* includes six triangles which constitute a regular hexagon on a center area of the compressed decorative surface 103, and six general trapezoids around the central regular hexagon. FIGS. 19 and 20 are respectively a perspective view and a plan view, which show a half-finished product 100' which is a die-cast semi-finished product to be finally formed to the fixing member 100. The half-finished product 100' comprises a base 101' and a shaft 102 (the same reference numeral as the shaft 102 of the fixing member 100 is assigned because they are substantially identical.). The base 101' and the shaft 102 become the base 101 and the shaft 102 of the fixing member 100. The base 101' includes a multi-face part 103' to be the compressed decorative surface 103 of the fixing member 100. The multi-face part 103' has a polyhedral appearance which is slightly convex upward (in the opposite side to the shaft 102 protruding side in FIG. 19). The multi-face part 103' includes, as the small sectional faces, six triangular faces 103'*a* constituting a regular hexagon on a center area, and six general trapezoid faces 103'*b* extending radially outward from the bottom sides of the respective triangular faces 103'*a*. The multi-face part 103' also includes ridges 103'*c* for obtusely joining between the triangular faces 103'*a* and between triangular faces 103'*a* and trapezoidal faces 103'*b*. The whole outside area of the above half-finished product 100' is plated (see FIG. 21). This plated half-finished product 100' is then barrel-polished. Thereby, as shown in FIG. 22, plated portions corresponding to the triangular faces 103'*a* and the trapezoidal faces 103'*b* on the multi-face part 103' are left, and the plating corresponding to the ridges 103'*c* is removed, exposing the ground color of the half-finished product 100'. Further, the plating corresponding to the circumferential edge of the base 101' is also removed to show the ground color. Next, a die or punch as not shown is used to axially compress the multi-face part 103' of the half-finished product 100' to form the fixing member 100 with the compressed decorative surface 103. At this time, the triangular faces 103'*a* and the trapezoidal faces 103'*b* on which the plating remains become the small sectional parts 103*a* on the compressed decorative surface 103, and the ridges 103'*c* with the plating removed become the boundaries 103*b* on the compressed decorative surface 103.

Figure 23:
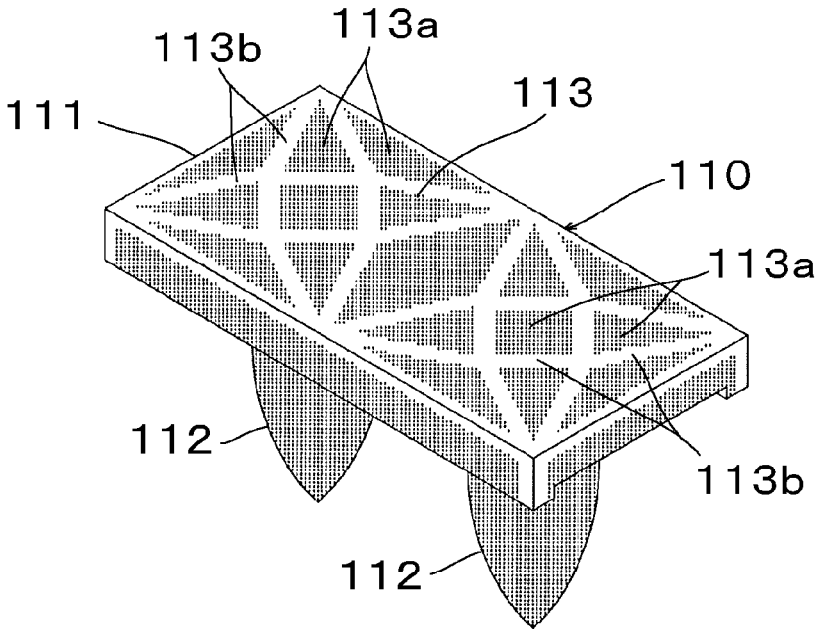
FIG. 23 is a perspective view showing a stopper for a slide fastener, which is another example of a metal component in accordance with the present invention.
Figure 24:
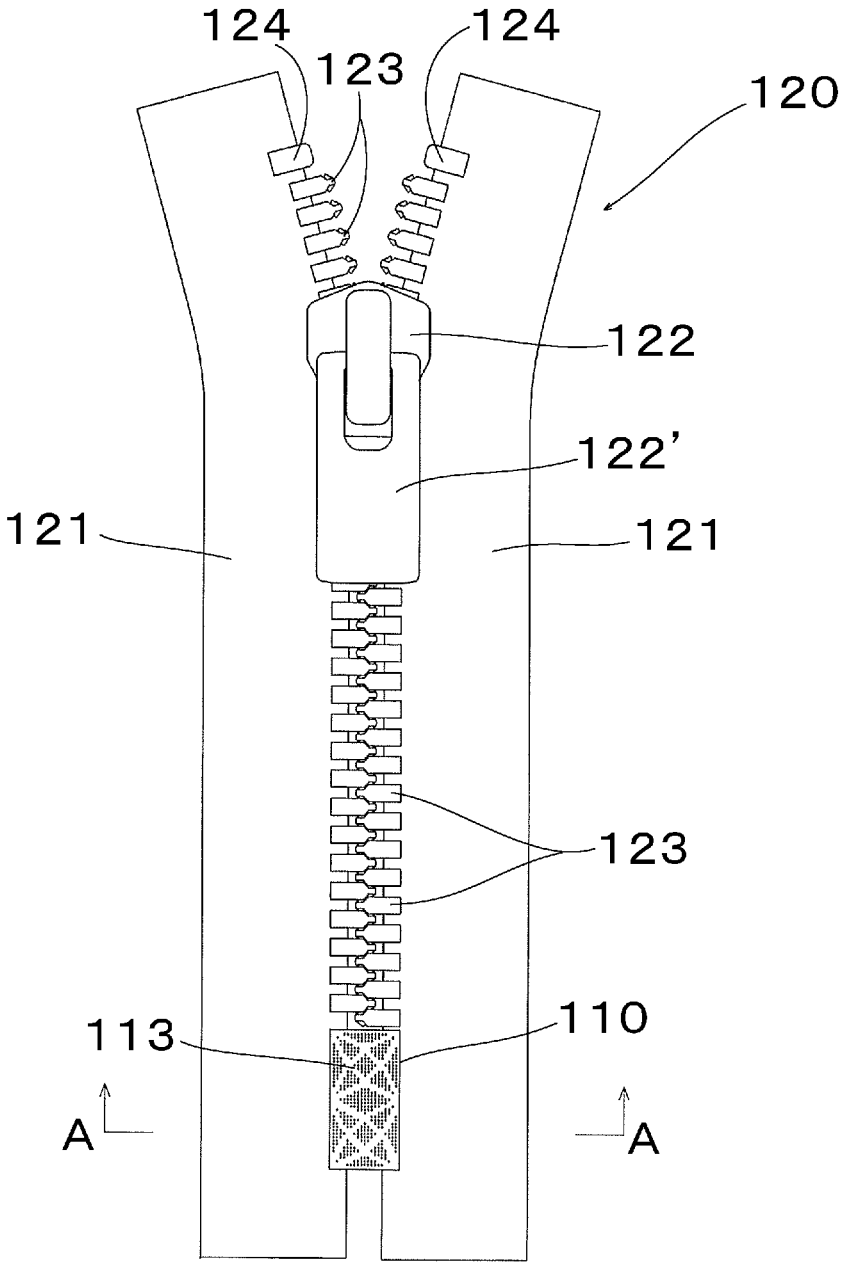
FIG. 24 is a plan view showing a slide fastener including the stopper in FIG. 23.
Figure 25:
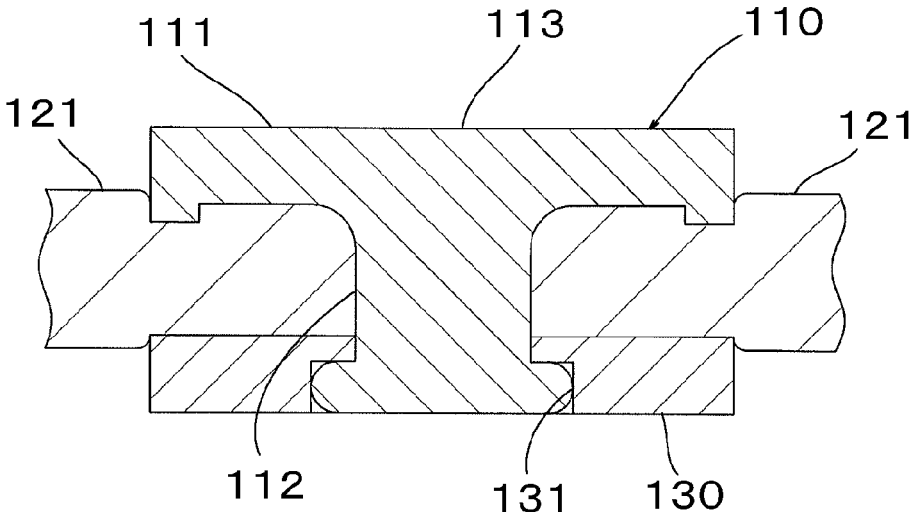
FIG. 25 is a cross-sectional view taken along the A-A line in FIG. 24.

FIGS. 23 to 28 show an example of a lower stopper 110 for a slide fastener, as still another embodiment of a metal component in accordance with the present invention. FIG. 23 is a perspective view of the lower stopper 110. FIG. 24 is a plan view of a slide fastener 120 which includes the lower stopper 110 shown in FIG. 23. FIG. 25 is a cross-sectional view taken along the A-A line in FIG. 24. The slide fastener 120 comprises a pair of right and left fastener tapes 121 which are long in the up and down direction (the up, down, left and right directions are based on FIG. 24), and a slider 122 which is manually moved up and down in order to open or close between both of the fastener tapes 121. The slider 122 has a puller 122' as connected thereto, which is pulled by a user to open or close between the fastener tapes. Each of the fastener tapes 121 includes a lot of fastener elements 123 for engagement along at the end facing to the opponent fastener tape in the up and down direction. The downward movement of the slider 122 releases the engagement between the right and left fastener elements 123 as connected to open between both of the fastener tapes 121. The upward movement of the slider 122 engages the right and left fastener elements 123 as unconnected to close between both of the fastener tapes 121. The lower stopper 110 is a stopper as attached between the right and left fastener tapes 121 in order to prevent the slider 122 from moving lower than the lower stopper 110. The reference numeral 124 in FIG. 24 indicates upper stoppers. The upper stoppers 124 are attached to upper facing ends of the right and left fastener tapes 121 to prevent the slider 122 from moving upper than the stoppers 124. The lower stopper 110 includes a base 111 like a rectangular plate and two shafts 112 protruding from the base 111 to the rear side. With reference to FIG. 25, the lower stopper 110 is fixed to the right and left fastener tapes 121 by swaging the shafts 112 after the shafts 112 are passed between the fastener tapes 121 to the rear side and then passed through a fastening hole 131 of a back plate 130.

Figure 26:
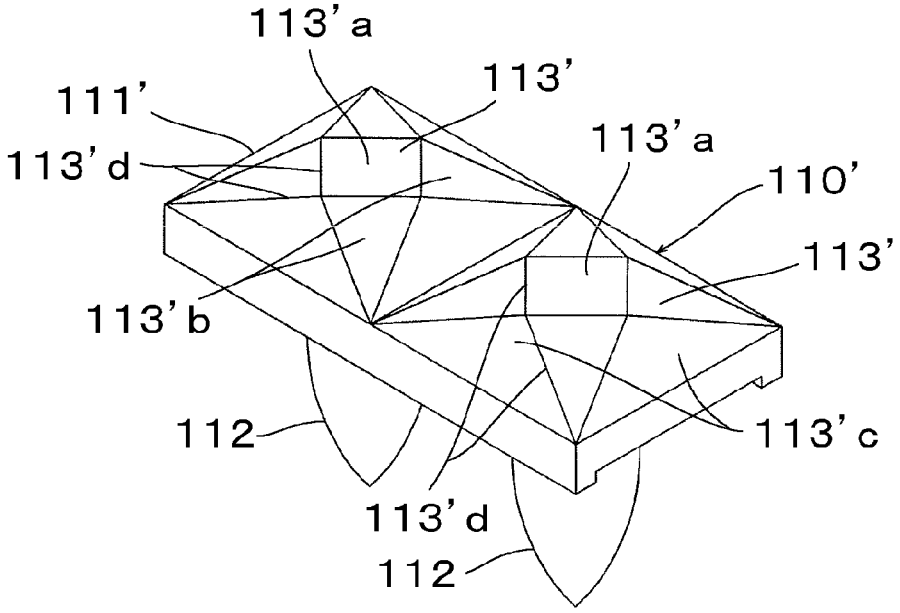
FIG. 26 is a perspective view showing a half-finished product which becomes the stopper in FIG. 23.
Figure 27:
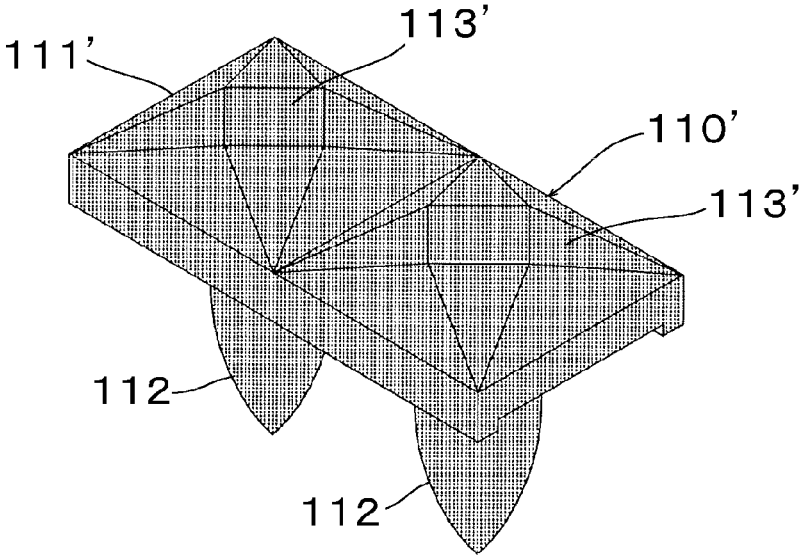
FIG. 27 is a perspective view showing a plated half-finished product.
Figure 28:
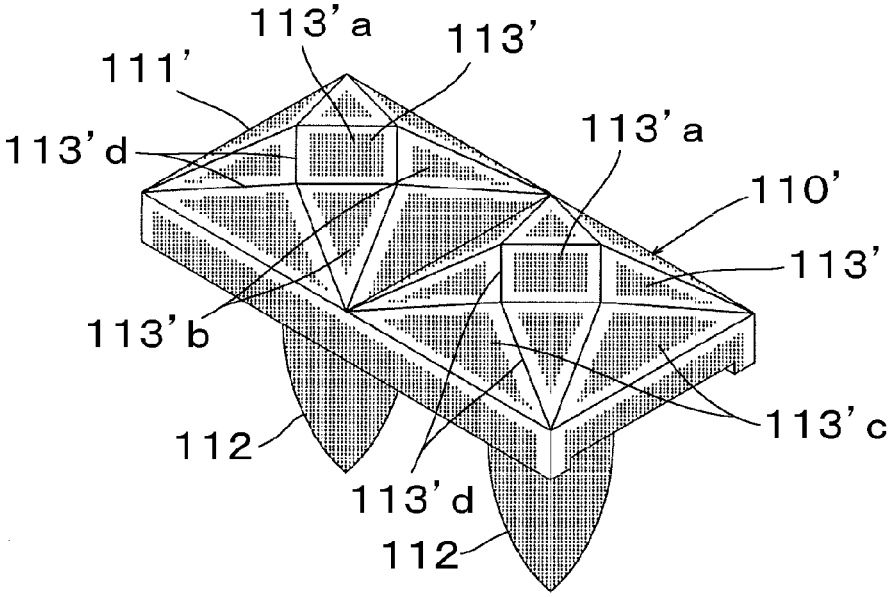
FIG. 28 is a perspective view showing a barrel-polished half-finished product.

The base 111 includes a rectangular compressed decorative surface 113, whose size is equal to the sum of two square regions on its surface. The compressed decorative surface 113 has a pattern composed of a plurality of small sectional parts 113*a* on which the plating remains as mentioned later, and boundaries 113*b* between adjacent small sectional parts 113*a* on which the plating is removed. The small sectional parts 113*a* includes a central square (four sides of the central square are parallel to the diagonals of each of the square regions) in each of the two square regions dividing the compressed decorative surface 113, two kinds of large and small triangles around the central squares, and a rhombus (whose size is equal to the sum of the two large triangles) striding the two square regions. FIG. 26 is a perspective view showing a half-finished product 110' which is a die-cast half-finished product to be finally formed to the lower stopper 110. The half-finished product 110' includes the base 111' and the shafts 112 (the same reference numeral as the shafts 112 of the lower stopper 110 is assigned because they are substantially identical.), which become respectively the base 111 and the shaft 112 of the lower stopper 110. The base 111' has two multi-face parts 113' becoming the two square regions on the compressed decorative surface 113 of the lower stopper 110. Each of the multi-face parts 113' has a central square face 113'*a* which is slightly convex in the front side and along a horizontal plane perpendicular to the axis of the shaft 112. The four sides are parallel to the diagonals of the respective square regions. Each multi-face part 113 also has four small triangular faces 113'*b* whose bottom sides correspond to the four sides of the central square faces 113'*a*, the apex angles of the small triangular faces 113'*b* pointing to the four corners of the respective square regions, and four large triangular faces 113'*c* whose bottom sides correspond to the four sides of the respective square regions, the apex angles of the large triangular faces 113'*c* pointing to the four corners of the respective central square faces 113'*a*. The respective multi-face parts 113' also includes ridges 113'*d* obtusely jointing between the square face 113'*a* and the small triangular faces 133'*b* and between the small triangular faces 113'*b* and the large triangular faces 113'*c*. The boundary between the two multi-face parts 113' becomes a valley not a ridge. The whole outside area of the half-finished product 110' is plated (se FIG. 27), and then is barrel-polished. Thereby, as shown in FIG. 28, on each of the multi-face parts 113', the plating corresponding to the square face 113'*a*, the small and large triangular faces 113'*b*, 113'*c* are left and the plating corresponding to the ridges 113'*d* is removed, exposing the ground color of the half-finished product 110'. Further, the plating at the outer edges of the front side of the base 111' and at the four corner edges of the sides of the base 111' is also removed to expose the ground color. Next, a die or a punch as not shown is used to compress the respective multi-face parts 113' of the half-finished product 110' to form the lower stopper 110 with one compressed decorative surface 113. At this time, the square faces 113'*a*, the small triangular faces 113'*b* and the large triangular faces 113'*c* with the plating remains become the small sectional parts 113*a* on the compressed decorative surface 113, and the ridges 113'*d* with the plating removed become the boundaries 113*b*.

Figure 29:
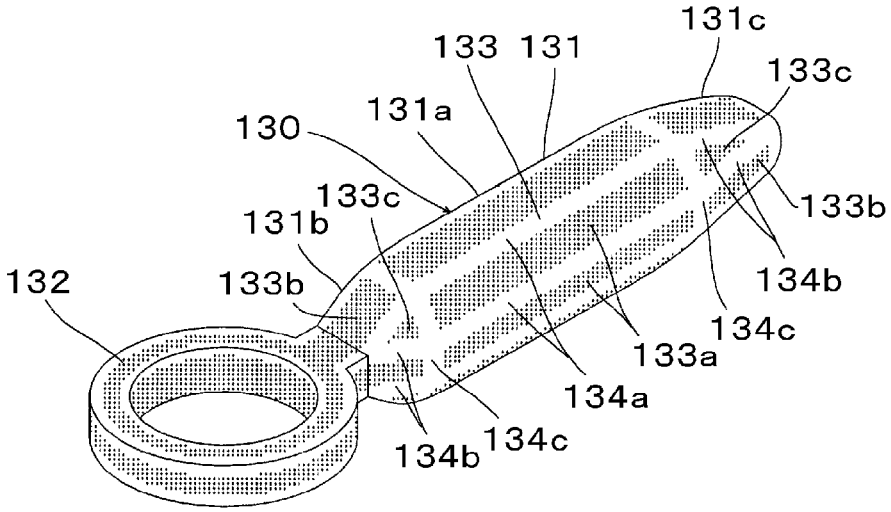
FIG. 29 is a perspective view showing a puller for a slide fastener, which is still another example of a metal component in accordance with the present invention.
Figure 30:
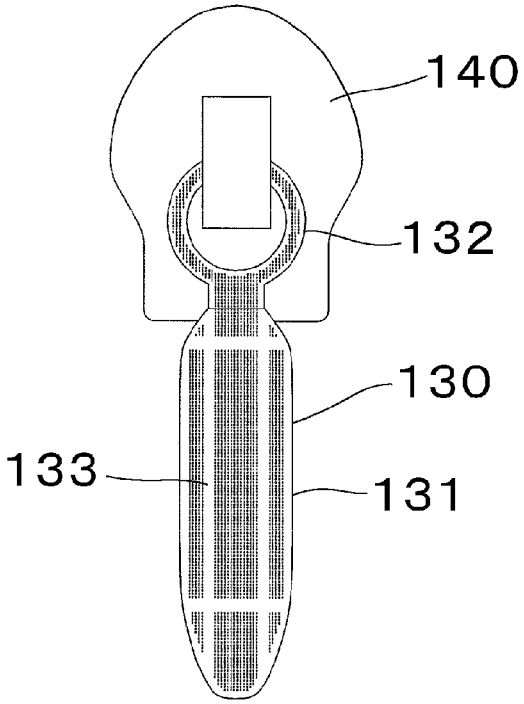
FIG. 30 is a plan view showing a slider to which the puller in FIG. 29 is connected.

FIGS. 29 to 33 show an example of a puller 130 for a slide faster, as still another embodiment of a metal component in accordance with the present invention. FIG. 29 is a perspective view showing the puller 130. The puller 130 is a component corresponding to a puller 122' in the slide faster 120 in FIG. 24. As shown in FIG. 30, the puller 130 comprises a generally columnar puller body 131, which is pulled by a user when the user opens or closes the slide fastener, and a circular annulus 132 for connecting the puller body 131 to a slider 140 of the slide fastener. The puller body 131 includes an intermediate part 131*a* whose diameter is substantially constant (a cross-sectional plane perpendicular to the axis of the intermediate part 131*a* is not a true circle), one end part 131*b* whose diameter is radially reduced from the intermediate part 131*a* to the annulus 132 and located adjacently to the annulus 132, and the other end part 131*c*, at the other side of the intermediate part 131*a*, the diameter of the other end part 131*c* being reduced in the direction away from the annulus 132. The whole outside area of the intermediate part 131*a* and the one end and the other end parts 131*b*, 131*c* become a compressed decorative surface 133. The compressed decorative surface 133 includes, on the intermediate part 131*a*, eight rectangular small sectional parts 133*a* on which the plating remains as described later and boundaries 134*a* between adjacent small sectional parts 133*a* on which the plating is removed. The compressed decorative surface 133 also includes, on the one end part 131*b* and the other end part 131*c*, rectangular small sectional parts 133*b* which are shorter than the small sectional parts 133*a* and triangular small sectional parts 133*c*, and boundaries 134*b* between the small sectional parts 133*b*, 133*c*. The compressed decorative surface 133 further includes boundaries 134*c* between the small sectional parts 133*a* on the intermediate parts 131*a* and the small sectional parts 133*b*, 133*c* on the one and other end parts 131*b*, 131*c*. The compressed decorative surface 133 is formed such that adjacent small sectional parts 133*a*, 133*b*, 133*c* are gently continuous in a curved form. The small sectional parts 133*a*, 133*b*, 133*c* and the boundaries 134*a*, 134*b*, 134*c* represent a unique pattern on the outside of the puller body 131.

Figure 31:
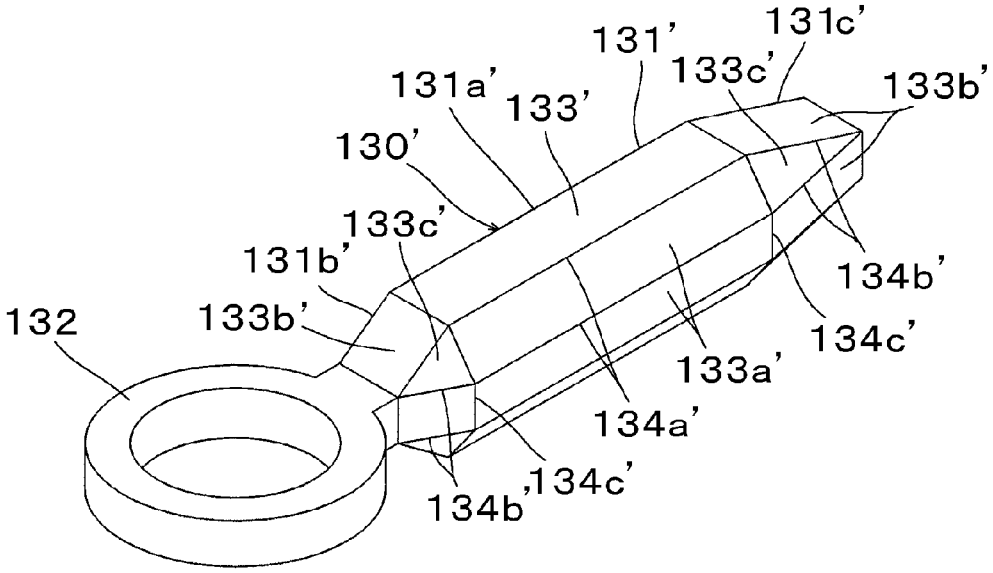
FIG. 31 is a perspective view showing a half-finished product which becomes the puller in FIG. 29.
Figure 32:
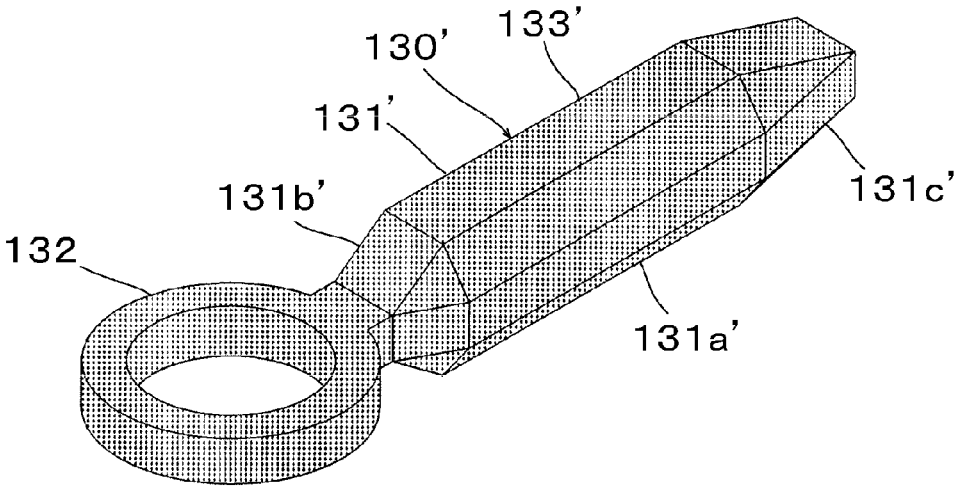
FIG. 32 is a perspective view showing a plated half-finished product.

FIG. 31 is a perspective view showing a half-finished product 130', which is a die-cast semi-finished product to be finally formed to the puller 130. The half-finished product 130' includes a member body 131' and an annulus 132 (the same reference numeral as the annulus 132 of the puller 130 assigned because they are substantially identical.), which become the puller body 131 and the annulus 132 of the puller 130. The member body 131' includes a multi-face part 133', which becomes the compressed decorative surface 133, on the whole outside area. The multi-face part 133' is sectioned into an intermediate part 131*a*', a one end part 131*b*' and the other end part 131*c*' which respectively become the intermediate part 131*a*, the one end part 131*b* and the other end part 131*c* of the puller body 131. The intermediate part 131*a*' is an octagonal columnar part, which includes eight rectangular faces 133*a*' as small sectional faces and eights ridges 134*a*' obtusely joining between the rectangular faces 133*a*'. The one and the other end parts 131*b*', 131*c*' include respectively four small rectangular faces 133*b*', four triangular faces 133*c*', and four ridges 134*b*' obtusely joining between the small rectangular faces 133*b*' and the triangular faces 133*c*'. The multi-face part 133' further includes ridges 134*c*', which obtusely join between the rectangular faces 133*a*' in the intermediate part 131*a*' and the small rectangular and triangular faces 133*b*' in the one end and the other end parts 131*b*', 131*c*'.

Figure 33:
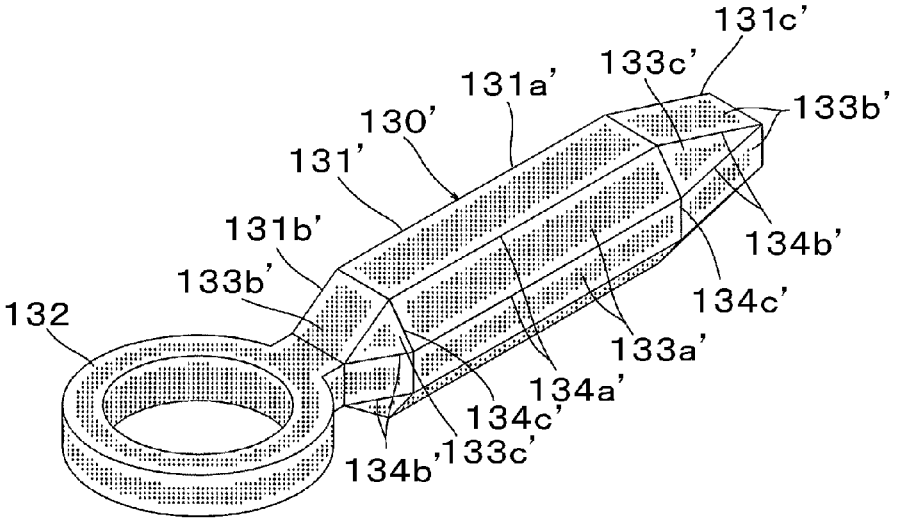
FIG. 33 is a perspective view showing a barrel-polished half-finished product.

Next, the whole outside area, including the annulus 132, of the half-finished product 130' is plated (see FIG. 32) and then is barrel-polished. Thereby, as shown in FIG. 33, plated portions, which correspond to the rectangular faces 133*a*' in the intermediate part 131*a*' and the small rectangular and triangular faces 133*b*', 133*c*' in the one end and the other end parts 131*b*', 131*c*', remain, and plating corresponding to the ridges 134*a*', 134*b*', 134*c*' has been removed, exposing the ground color of the half-finished product 130. Also, plating at the edge of the annulus 132 is removed to expose the ground color. Next, a die as not shown is used to compress the multi-face part 133' as the whole outside area of the member body 131' of the half-finished product 130' to form the puller 130. At this time, the rectangular faces 133*a*', the small rectangular faces 133*b*' and the triangular faces 133*c*' on which the plating remains become the small sectional parts 133*a*, 133*b*, 133*c* in the compressed decorative surface 133. And the ridges 134*a*, 134*b*' and 134'*c* on which the plating is removed become the boundaries 134*a*, 134*b*, 134*c*. In the above explanation, the lower stopper 110 and the puller 130 are cited as components for the slide fastener, to which the pattern is given composed of the small sectional parts 113*a*, 133*a*, 133*b*, 133*c* on which plating remains and the boundaries 113*b*, 134*a*, 134*b*, 134*c* on which plating is removed. However, the invention is not limited thereto, and it would be possible to provide such a pattern to the upper stoppers 124, the fastener elements 123 and the sliders 122, 140 for a slide fastener.

DESCRIPTION OF PREFERENCE NUMBERS

10, 70, 90 decorative button (metal component)
10', 10", 70', 100', 110', 130' half-finished product
12, 72, 83, 93, 103, 113, 133 compressed decorative surface
12', 72', 103', 113', 133' multi-face part
12*a*, 72*a*, 93*a*, 103*a*, 113*a*, 133*a*, 133*b*, 133*c* small sectional part
12*b*, 72*b*, 93*b*, 103*b*, 113*b*, 134*a*, 134*b*, 134*c* boundary
12*b*' first boundary
12*b*" second boundary
12" circular face (small sectional face)
13'*a* small sectional face
13*b*, 13'*b*, 72'*c*, 103'*c*, 113'*d*, 134*a*', 134*b*', 134*c*' ridge
72'*a* square face (small sectional face)
72'*b* trapezoidal face (small sectional face)
80 button (metal component)
100 button fixing member (metal component)
103'*a* triangular face (small sectional face)
103'*b* trapezoidal face (small sectional face)
110 lower stopper for slide fastener (metal component)
113'*a* square face (small sectional face)
113'*b* small triangular face (small sectional face)
113'*c* large triangular face (small sectional face)
130 puller for slide fastener (metal component)
133*a*' rectangular face (small sectional face)
133*b*' small rectangular face (small sectional face)
133*c*' small triangular face (small sectional face)

The invention claimed is:

1. A method for forming a metal component having a compressed decorative surface which is planar or curved, wherein the compressed decorative surface has a pattern which is composed of a plurality of sectional parts on which a coating material as coated remains and boundaries between adjacent sectional parts on which the coated coating materials is removed, wherein the method includes:

a step A of obtaining a half-finished product which becomes the metal component, the half-finished product including a multi-face part which includes, in at least a part of an outside area thereof, a plurality of sectional faces and ridges obtusely joining two adjacent sectional faces;

a step B of coating the multi-face part with a coating material whose color differs from a ground color of the outside area, wherein the step B is carried out by plating the multi-face part;

a step C of removing the coating material on portions corresponding to the ridges of the multi-face part and leaving the coating material on portions corresponding to the sectional faces; and a step D of compressing at least a part of the multi-face part to form the compressed decorative surface in which the portions corresponding to the sectional faces become the sectional parts and the portions corresponding to the ridges become the boundaries.

2. The method according to claim 1, wherein the metal component is a button or a button fixing member.

3. The method according to claim 1, wherein the metal component is a component for a slide fastener.

4. The method according to claim 1, wherein the step C is carried out by barrel-polishing the half-finished product.

* * * * *

UNITED STATES PATENT AND TRADEMARK OFFICE

CERTIFICATE OF CORRECTION

PATENT NO. : 9,492,844 B2
APPLICATION NO. : 13/703070
DATED : November 15, 2016
INVENTOR(S) : Kenji Hasegawa et al.

It is certified that error appears in the above-identified patent and that said Letters Patent is hereby corrected as shown below:

In the Specification

In Column 11, Line 47, delete "identical.)," and insert -- identical), --, therefor.

In Column 12, Line 67, delete "identical.)," and insert -- identical), --, therefor.

Signed and Sealed this
Eighteenth Day of April, 2017

Michelle K. Lee

Michelle K. Lee
*Director of the United States Patent and Trademark Office*